US005813569A

United States Patent [19]

Cihanek

[11] Patent Number: 5,813,569

[45] Date of Patent: Sep. 29, 1998

[54] POINT-OF-SALE MERCHANDISER

[75] Inventor: Lawrence Cihanek, Wappinger Falls, N.Y.

[73] Assignee: Elite Licensing Inc., Pleasantville, N.Y.

[21] Appl. No.: 614,304

[22] Filed: Mar. 12, 1996

[51] Int. Cl.[6] ..... B65D 83/00

[52] U.S. Cl. ..... 221/150 R; 221/198; 221/303; 62/393; 312/71; 312/36; 312/137

[58] Field of Search ..... 221/150, 198, 221/199, 282, 283, 287, 303; 312/71, 36, 137; 62/393–396, 399

[56] References Cited

U.S. PATENT DOCUMENTS

| | | | |
|---|---|---|---|
| 2,397,403 | 3/1946 | Bishop | 221/150 R |
| 2,499,089 | 2/1950 | Brill et al. | 312/36 |
| 3,097,899 | 7/1963 | Dean et al. | 312/36 |
| 3,287,073 | 11/1966 | Holtkamp | 312/36 |
| 3,942,683 | 3/1976 | Haas . | |
| 4,046,284 | 9/1977 | Samuelsson | 221/303 |
| 4,598,828 | 7/1986 | Young et al. . | |

FOREIGN PATENT DOCUMENTS

| | | | |
|---|---|---|---|
| 403235196 | 10/1991 | Japan | 221/150 R |

*Primary Examiner*—H. Grant Skaggs

*Attorney, Agent, or Firm*—Cohen, Pontani, Lieberman & Pavane

[57] ABSTRACT

A point-of-sale merchandiser for merchandising products adjacent a cashier counter. The merchandiser includes a housing having a top opening and a product dispensing rack disposed upright in the housing. The dispensing rack is positioned in the housing so that products supported thereon are accessible through the top opening. The dispensing rack has a bottom surface and includes a plurality of base plates and vertical guides. Each base plate is configured to support a plurality of vertically stacked products disposed thereon. The dispensing rack further includes a plurality of biasing members disposed between the base plates and the bottom surface of the dispensing rack for urging the base plates upwardly along a vertical path defined by the vertical guides so that each of the vertically stacked products may be sequentially dispensed through the top opening of the housing. The housing may include a refrigeration mechanism for cooling the products contained therein.

20 Claims, 8 Drawing Sheets

FIG. 1
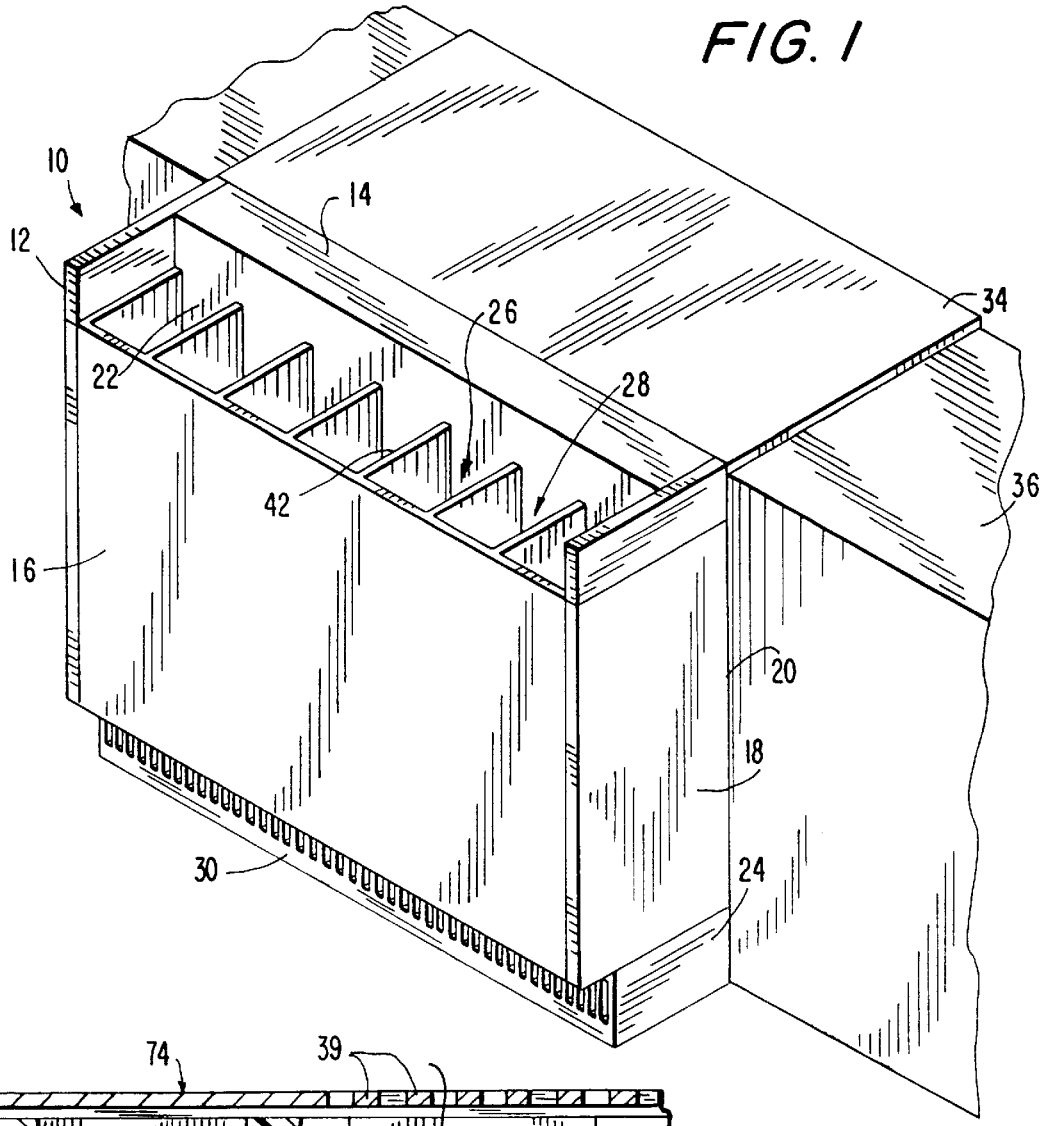
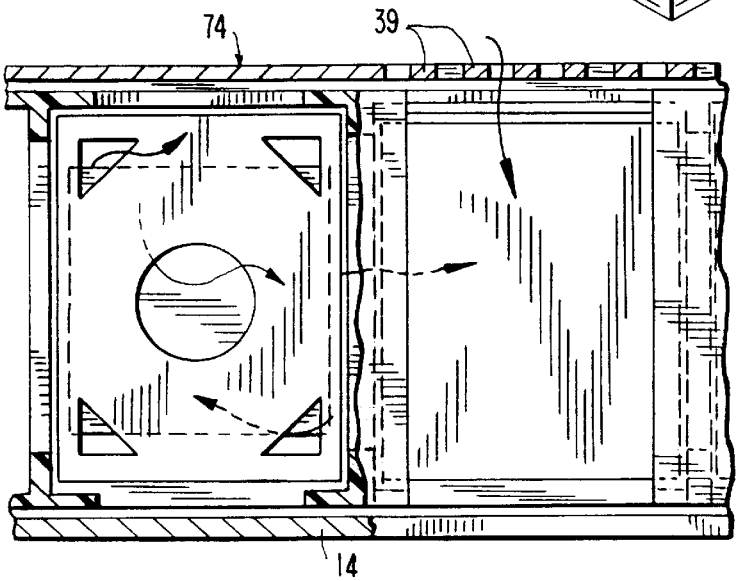
FIG. 6

POINT-OF-SALE MERCHANDISER

BACKGROUND OF THE INVENTION

1. Field of the Invention

The present invention relates to a product merchandiser and, in particular, a point-of-sale merchandiser comprising a housing having a top opening and a product dispensing rack disposed in the housing for dispensing products upwardly through the top opening. The merchandiser may further include a refrigeration mechanism for cooling the products contained therewithin.

2. Description of the Prior Art

Point-of-sale merchandisers enable a retailer to increase sales through attractive display of products at a convenient location. The merchandisers must also provide simple access to the displayed products. Typically, the merchandisers are positioned adjacent cashier counters so as to prompt impulse-buying. As such, point-of-sale merchandisers must be compact, as space adjacent the cashier counter is at a premium.

Much creative energy has been expended in designing display trays, shelf units and cabinets which facilitate access of products in a retail environment. However, known point-of-sale display units do not provide a space-efficient enclosure which stores the displayed products in a compact, vertically stacked arrangement and provides a simple upward-delivery system for dispensing products through a top opening.

Some point-of-sale merchandisers also provide refrigeration for the displayed products. A common refrigerated merchandiser is a free-standing freezer box having an opening at the top for accessing products therein. However, such units tend to be bulky and require relative large floor space. Furthermore, the displayed products are often stacked in one or two large spaces defined by the enclosure with the consequence that the displayed products become disarrayed as shoppers pick and choose among the products.

SUMMARY OF THE INVENTION

It is therefore an object of the present invention to provide a space-efficient merchandiser that is abuttable against a cashier counter.

Another object of the invention is to provide a merchandiser having a product display rack disposable within a merchandiser for displaying and dispensing vertically stacked products upwardly and sequentially through a top opening.

Still another object of the invention is to provide a refrigeration mechanism for cooling items such as, for example, packaged dinner entrees, soft drinks and/or ice cream displayed in the merchandiser.

Yet another object of the invention is to provide a merchandiser with an interchangeable facing.

An embodiment of the present invention provides a point-of-sale merchandiser for merchandising products. The merchandiser includes a housing defining an interior chamber and having an opening in an upper portion thereof for communication with the chamber. A dispensing rack is disposed in the chamber and has a bottom and a top, the dispensing rack including at least one base plate dimensioned to support a plurality of products vertically stacked thereon, a biasing mechanism for urging the base plate from a lower position near the bottom of the dispensing rack to an upper position near the top of the dispensing rack, and a guide mechanism for guiding the plurality of products stacked on the base plate for movement relative to the housing along a substantially vertical path as the base plate moves from its lower position to its upper position such that the products are sequentially accessible through the opening in the upper portion of the housing.

In another embodiment, the merchandiser further includes a mechanism for cooling and circulating air in the interior chamber so as to chill the products supported by the dispensing rack.

In still another embodiment, the merchandiser further includes a cold wall disposed proximate the dispensing rack inside the housing for chilling the products by natural convection cooling.

Other objects and features of the present invention will become apparent from the following detailed description considered in conjunction with the accompanying drawings. It is to be understood, however, that the drawings are not drawn to scale, are conceptual in nature and designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views:

FIG. 1 is a perspective view of an embodiment of a merchandiser constructed in accordance with the present invention;

FIG. 6 is a sectioned view along lines 6—6 of FIG. 5;

DETAILED DESCRIPTION OF THE PRESENTLY PREFERRED EMBODIMENTS

Figure 2:
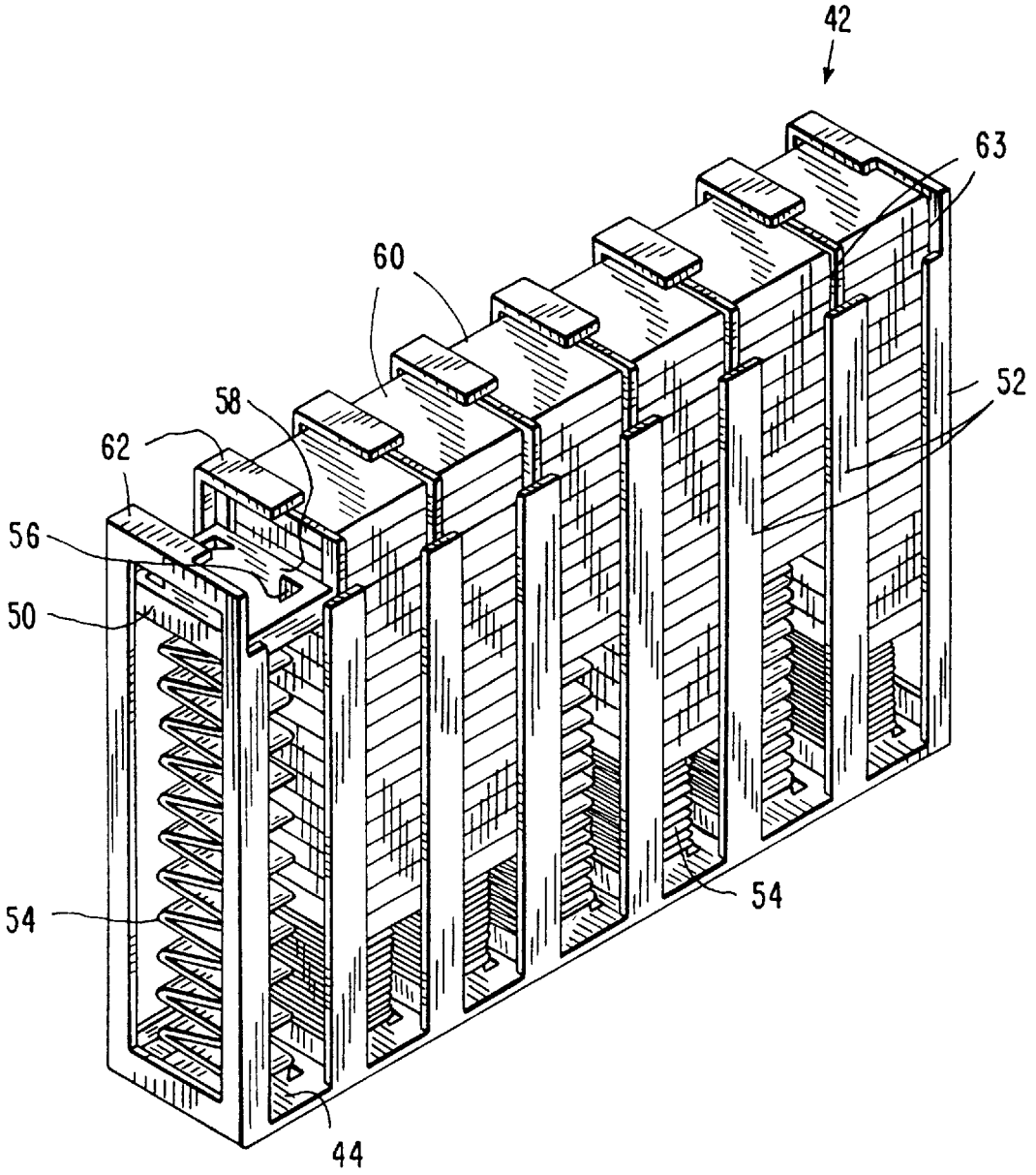
FIG. 2 is a perspective view of an embodiment of the product dispensing rack of the present invention.

As shown in FIGS. 1 and 2, an embodiment of the point-of-sale merchandiser 10 constructed in accordance with the present invention for displaying and dispensing products 60 includes a housing 12 having a top wall 14, a front wall 16, side walls 18, a rear wall 20, a partition 22 and a base 24 having a front surface 30 recessed from the front wall 16. An opening 26 in the top wall 14 communicates with an interior chamber 28 defined by housing 12. The merchandiser 10 further includes a product dispensing rack 42 disposed in the interior chamber 28 between front wall 16 and partition 22 for storing and displaying vertically stacked products and for sequentially dispensing them upwardly through the top opening 26. Optionally, the merchandiser 10 may include a display surface or mat 34 disposable on an adjacent horizontal surface such as, for example, a cashier counter 36 for displaying advertising messages and/or creating the illusion that the merchandiser 10 and counter comprise an integral unit. The mat 34 may be dimensioned to match the available surface dimension of the adjacent counter. As will be more fully explained in connection with other embodiments described herein, merchandiser 10 may also include a refrigeration mechanism (not shown) for cooling products 60 disposed in chamber 28.

Depicted in FIG. 2 is a preferred embodiment of the product dispensing rack 42. The rack 42 includes a bottom surface 44, a plurality of base plates 50, a plurality of vertical guide rails 52, and a plurality of biasing members 54, one for each base plate 50. As shown, the base plates 50 are preferably arranged side-by-side to form a row of dispensers, though this is not mandatory and other arrangements will suggest themselves to those skilled in the art once this description is known, the exact number of base plates and their arrangement being dictated only by the size of the chamber 28 and the dimensions of the products to be dispensed by the merchandiser 10. The biasing members 54, which may, for example, be helical coil springs, constant-force springs (as shown in FIG. 2) or conical springs, may be disposed between the base plates 50 and the bottom surface 44 of the rack 42 or so connected to the base plates 50 such that the base plates 50 are resiliently urged by biasing members 54 from a lower position near the bottom of rack 42 to an upper position near the top thereof. As will be more fully explained hereafter, each base plate 50 preferably includes one or more apertures 56 and one or more ribs 58 formed on the upper surface thereof to facilitate circulation of air through the base plate 50 when products 60 are disposed thereon.

The vertical guide rails 52 are configured to guide the base plates 50 and the product 60 supported thereon in a vertical path as they move between their lower and upper positions under the urging of the springs 54. For base plates 50 that are rectangular in shape, the rails 52 are preferably configured to slidably guide the corners of the base plates 50. For this purpose, two rows of rails may be provided, a front row and a back row, with the rails 52 disposed at either end of the rack 42 having generally L-shaped cross-sections and the intermediate rails 52 having generally T-shaped cross-sections. While rails 52 are presently preferred for guiding the product 60 during vertical or linear movement, other configurations and/or mechanisms for guiding the product 60 will suggest themselves to those skilled in the art who have read the description and all such alternative configurations and/or mechanisms are to be considered equivalent to the guide rails 52 for purpose of the present invention.

To limit upward movement of product 60 supported on base plate 50, a stop such as, for example, flanges 62 may be disposed at the top of the back row of rails 52, though it is contemplated that the stop may comprise any geometrical configuration sufficient to block upward movement of product 60. As shown, flanges 62 preferably project laterally over adjacent base plates 50, either partially or fully across the width between adjacent rails, and are dimensioned, for example, to span from about ½ to ⅓ the distance between front and back rails 52 so that product can be retrieved by lifting a proximal end of a product 60 and pulling it outwardly in a manner best illustrated by FIG. 10. To facilitate such removal the front row of rails 52 preferably terminates below the flanges 62 for defining a notch 63 having a height equal to or greater than the thickness of a unit of product 60 (see FIG. 2). Each dispenser in the merchandiser 10 can be refilled by inserting a product 60 to be loaded through the same opening from which product 60 is removed and then depressing the distal end of the product 60 against the uppermost or outermost product supported on the corresponding plate 50, or against the plate 50 itself if the dispenser is empty, and then sliding the distal end of the product 60 toward the back rail 52 and under the flange 62.

It is contemplated that instead of biasing members 54 there may be implemented an active feedback control system having feedback sensors and drive systems for controllably moving the base plates 50 between their upper and lower positions in rack 42. The drive systems may include the use of a pneumatic air-bag type mechanism or an electro-mechanical drive mechanism employing a pulley-and-belt arrangement or a gear-and-power screw arrangement to deliver the vertically stacked products upwardly toward opening 26. As the details of such mechanisms will be readily apparent to those skilled in the art who have read this specification, a further description thereof is deemed unnecessary. Indeed, any mechanism capable of urging base plates 50 upward toward top opening 26 as product 60 is sequentially dispensed will suffice and all such mechanisms should be considered as equivalents for purposes of the present invention.

Though the base plates 50 shown in FIG. 2 are uniform in size and shape, it is contemplated that the base plates 50 may be selectively dimensioned and configured so that products of varying size or shape such as, for example, bottles, cans, boxes, etc., may be supported thereon.

Figure 3:
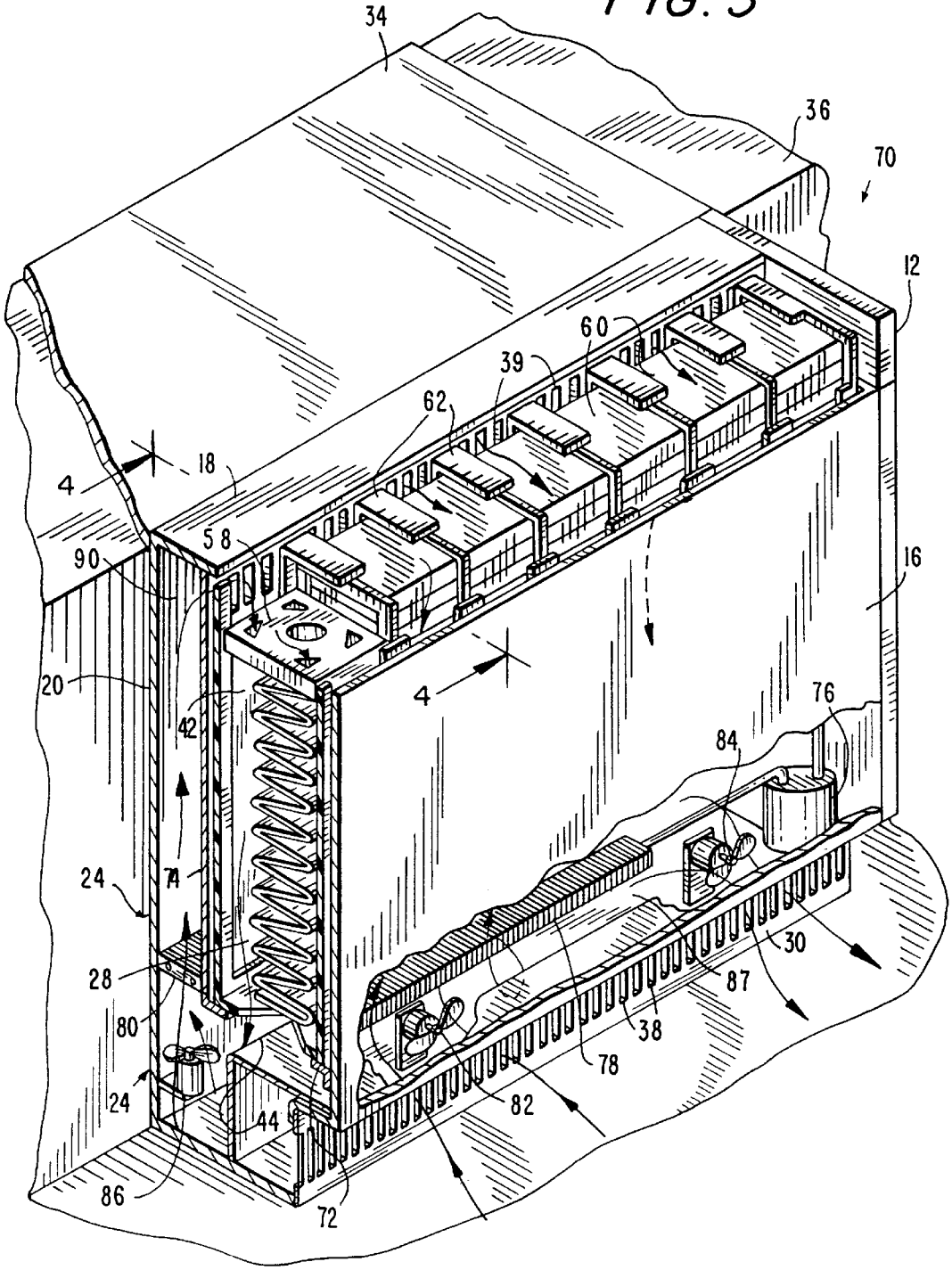
FIG. 3 is a partially sectioned perspective view of another embodiment of the merchandiser of the present invention.

FIG. 3 illustrates another refrigerated embodiment of the merchandiser 70 of the present invention. The merchandiser 70 includes the dispensing rack 42 of FIG. 2 fixedly mounted or slidably received in the interior chamber 28 and a refrigeration mechanism for cooling and circulating air in the chamber 28. As will be explained more fully hereinafter, for air flow or ventilation purposes the merchandiser 70 may include ventilation openings, such as lower vent holes 38 and upper vent holes 39 in the recessed front surface 30 and the partition 74, respectively. As depicted, the bottom surface 44 of rack 42 rests on stops 72 affixed to the partition 74 and the front wall 16 thereby defining a space below the rack 42 for housing the refrigeration mechanism.

Figure 4:
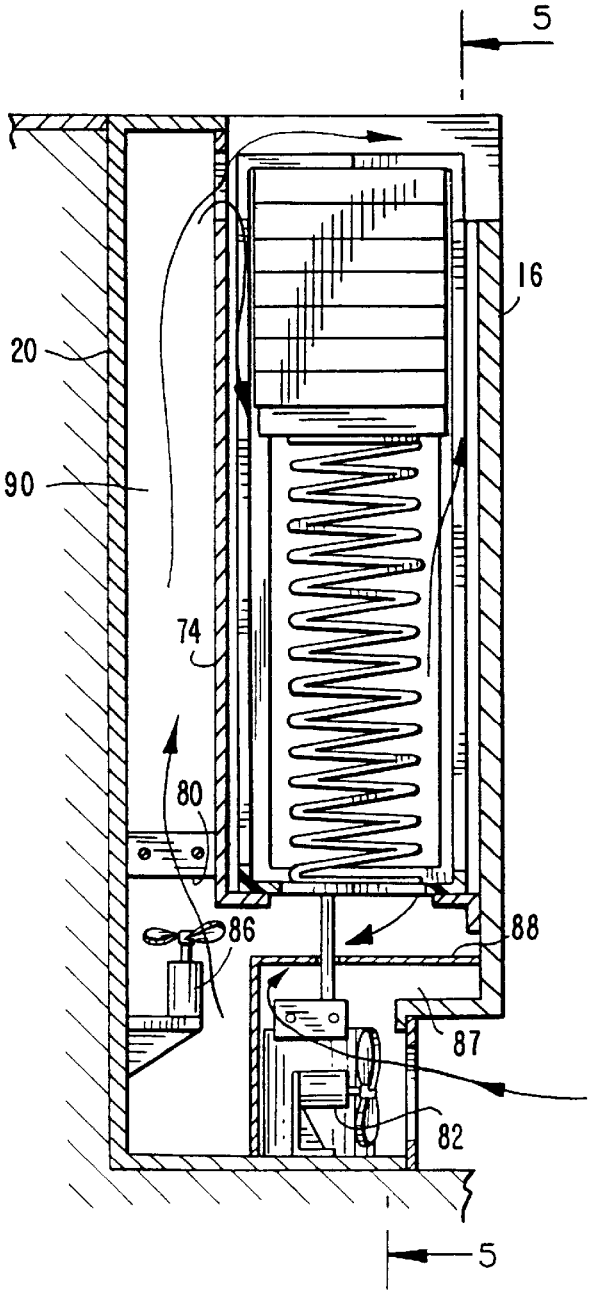
FIG. 4 is a sectioned view along lines 4—4 of FIG. 3.
Figure 5:
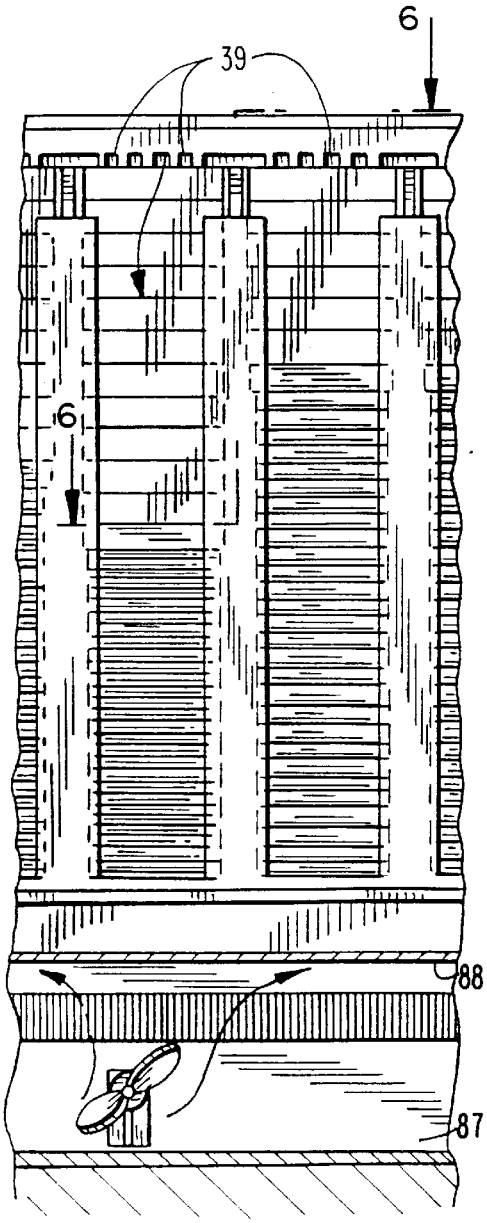
FIG. 5 is a sectioned view along lines 5—5 of FIG. 4.

The refrigeration mechanism may comprise a compressor 76, a condenser 78, an evaporator 80, an intake fan 82, an exhaust fan 84, and a circulating blower 86. Preferably, compressor 76, condenser 78 and fans 82, 84 are disposed in a compartment 87 below the rack 42. As best seen in FIGS. 4–5, the compartment 87 is defined by a baffle 88 whereby air flow in the compartment 87 is isolated from the rack 42. As shown in FIG. 3, the intake and exhaust fans 82, 84 may be disposed such that ambient air enters the left side of the merchandise 10 and heated exhaust air exits at the right so as to cool the condenser 78.

As depicted in FIGS. 3 and 4, the evaporator 80 is preferably disposed in an air plenum 90 formed by the rear wall 20 and the partition 74 and the circulating fan 86 is mounted proximate the inlet of the plenum 90 beneath the evaporator 80. FIGS. 3–6 illustrate an air flow management scheme wherein chilled air passing through the evaporator 80 is channeled into the plenum 90, out through the upper vents 39, downwardly past the vertically stacked products 60, and then back through the evaporator 80 for re-cooling. FIGS. 4, 5 and 6 show that the display rack 42 is preferably constructed such that chilled air flows over the front and back of the products 60 as well as between the columns of vertically stacked products 60.

Although not shown, it is contemplated that the refrigeration components including, for example, the compressor 76, evaporator 80, and condenser 78 may be disposed at a location outside the merchandiser housing 12. In such an embodiment, chilled air would be channeled into the housing 12 as by, for example, a flexible hose and air warmed by the products and/or the ambient environment may, for example, be recirculated, as by another flexible hose, through an outlet in the housing 12 for re-cooling by the remotely located refrigeration components. Alternatively, the warmed air is not re-cooled and may be exhaust out of the housing through, for example, the top opening of the merchandiser. This embodiment advantageously offers a more compact housing and quieter operation than the refrigerated merchandisers 10 and 70 depicted in FIGS. 1 and 3.

Figure 7:
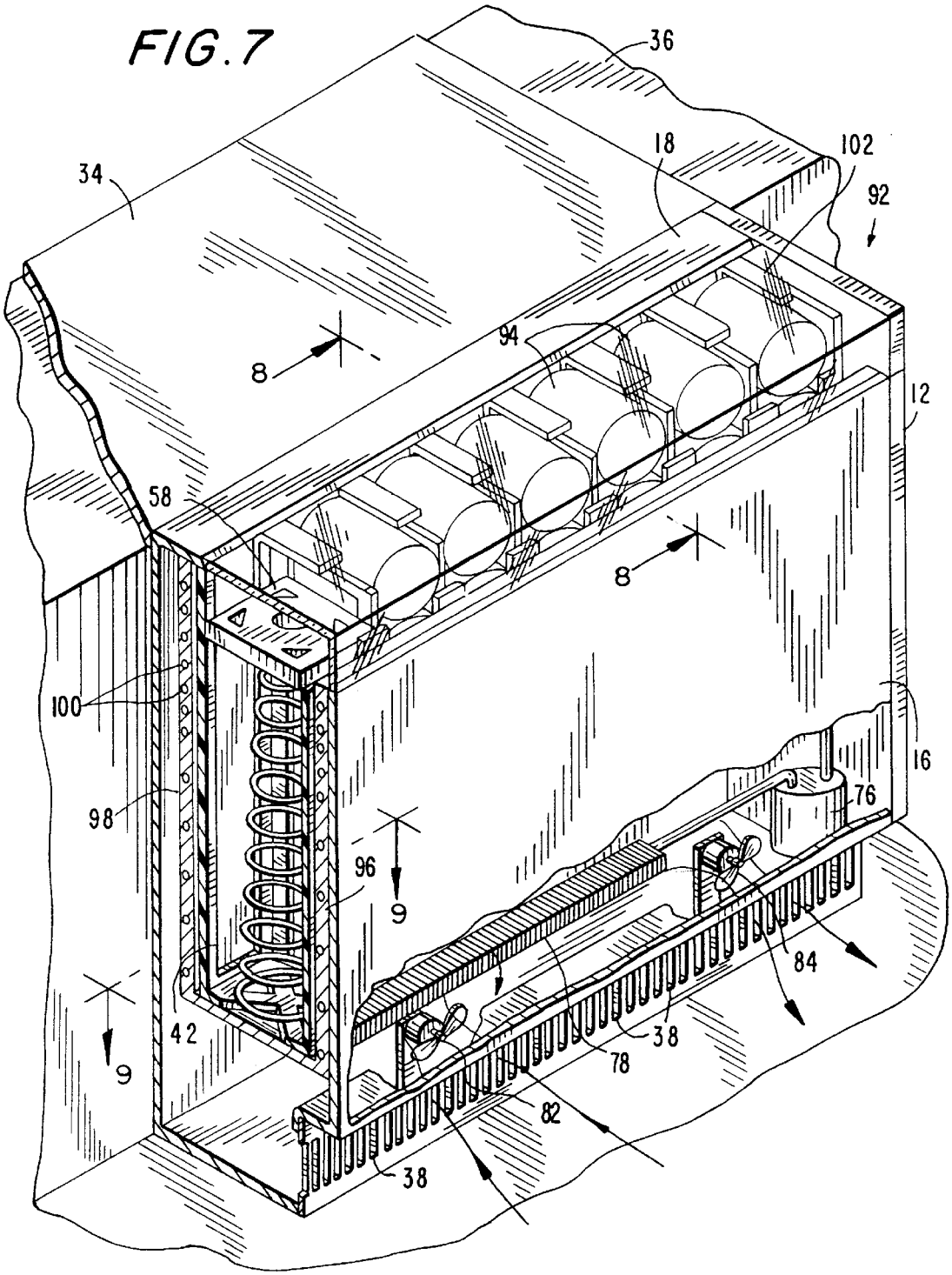
FIG. 7 is a partially sectioned view of still another embodiment of the merchandiser of the present invention.

FIG. 7 illustrates another embodiment of the merchandiser of the invention generally designated as 92. Rather than using forced air as in the embodiment of FIG. 3, the products 94 such as, for example, canned beverages, are chilled by a cold wall, preferably, both a front cold wall 96 and a rear cold wall 98. The cold walls 96, 98 are disposed closely proximate the display rack 42 such that the air surrounding the products 94 is cooled thereby chilling the products 94 by natural convection. The cold walls 96, 98 may, for example, comprise cooling tubes 100 for transporting cooling fluid medium adjacent the cold wall surface or, alternatively, as shown in FIG. 9, cooling tubes 100 may be embedded in the walls 96, 98. As best depicted in FIGS. 7 and 8, to compensate for greater heat transfer at the top opening 104 of the merchandiser 92, additional cooling tubes 100 may be disposed at the top of the cold walls 96, 98.

Figure 8:
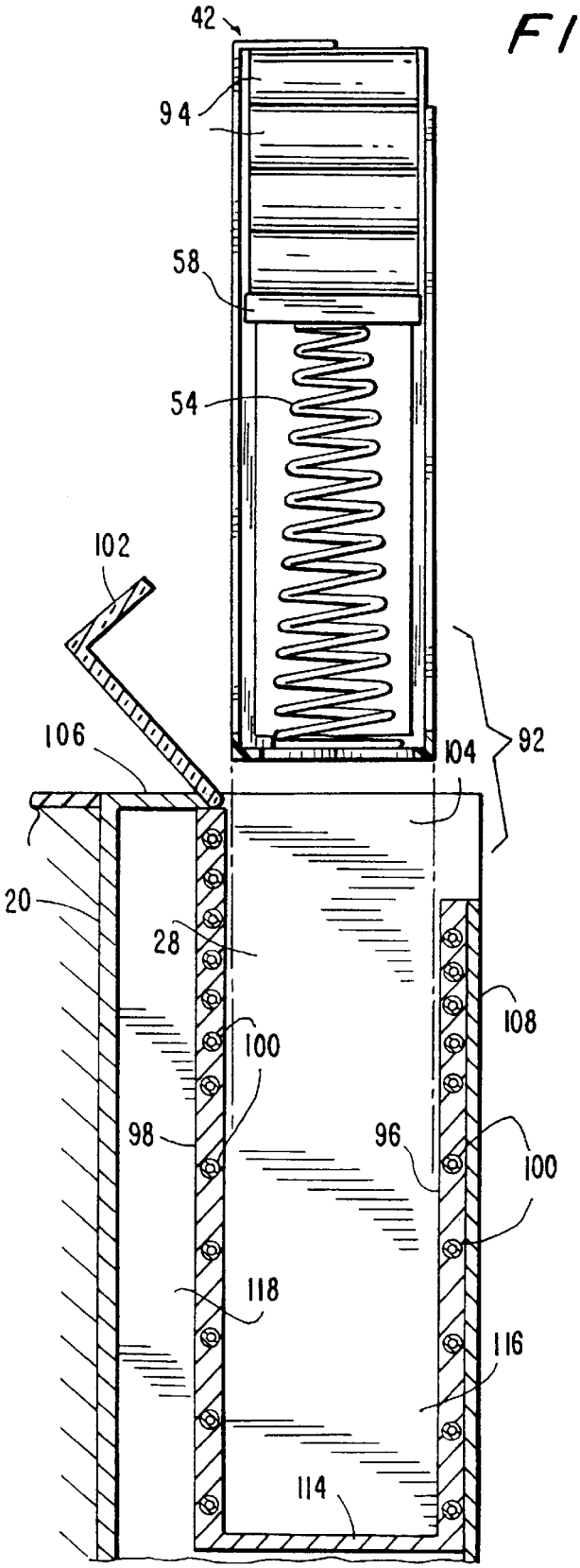
FIG. 8 is a sectioned view along lines 8—8 of FIG. 7.
Figure 9:
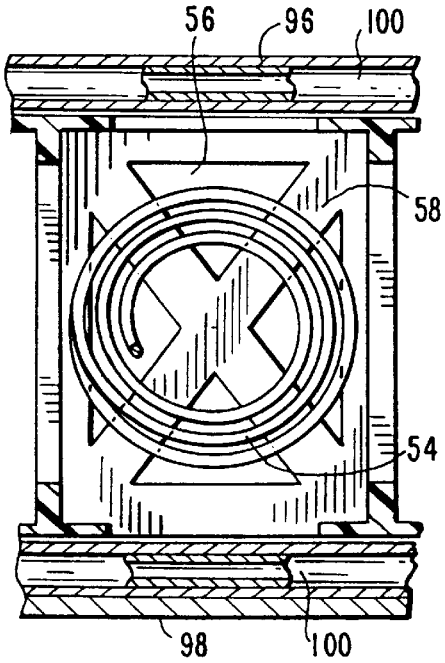
FIG. 9 is a sectioned view along lines 9—9 of FIG. 7.

FIG. 8 shows that the merchandiser 92 may include a preferably transparent openable cover 102 for minimizing heat transfer with ambient air adjacent the top opening 104, i.e., when the cover 102 is closed it prevents the chilled air in the chamber 28 from escaping. The cover 102 may, for example, be hingedly connected to the top wall 106 of the merchandiser housing 108 or may comprise a pair of laterally slidable doors. FIG. 8 further illustrates that the front and rear cold walls 96, 98 may be connected through a bottom wall 114 so as to define a refrigerated section 116 inside the interior chamber 118 such that the product display rack 42 may be slidably inserted into the refrigerated section 116 and supported on the bottom wall 114. If desired, bottom wall 114 may be provided with additional cooling tubes 100.

Figure 10:
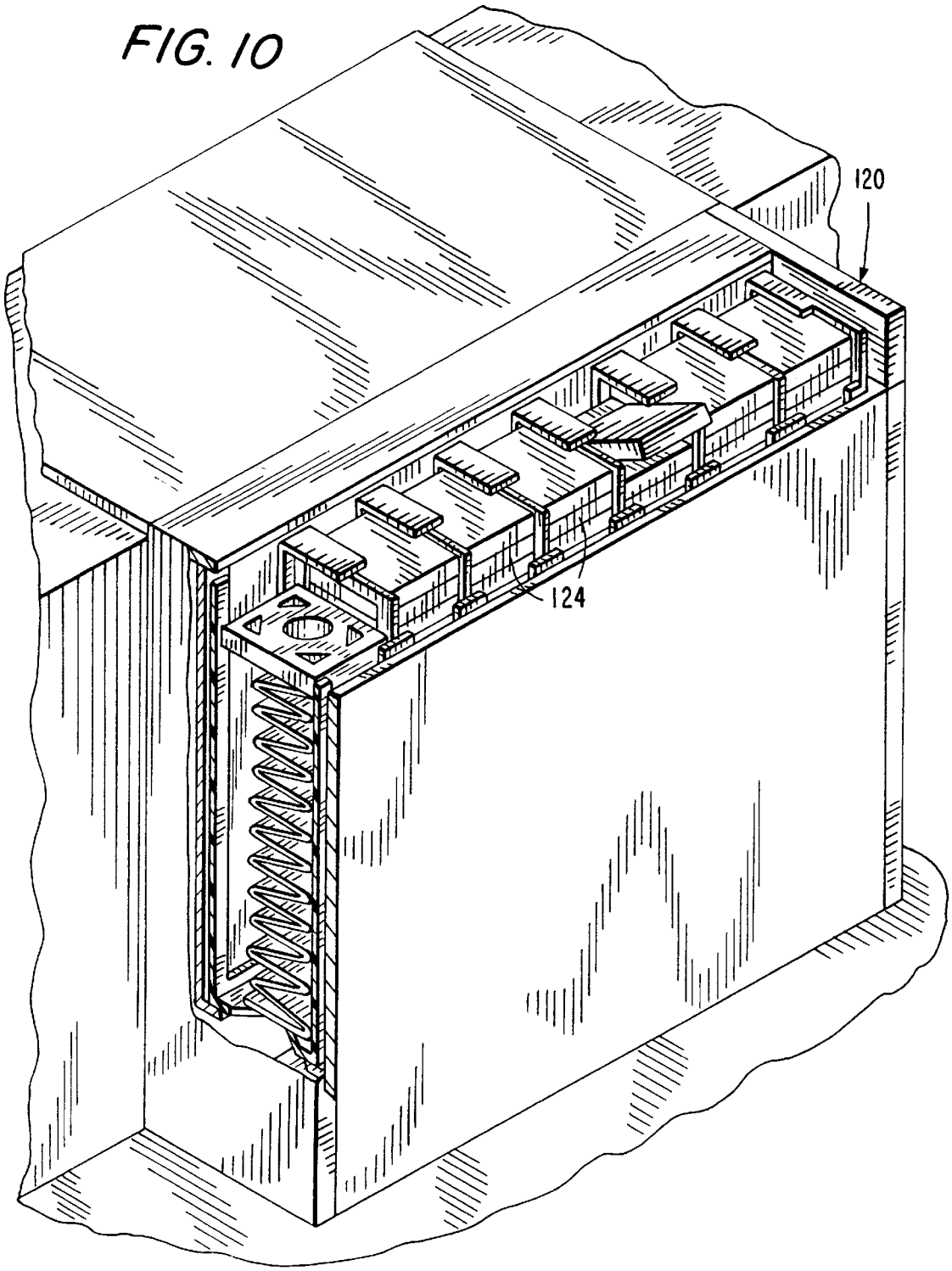
FIG. 10 is a partially sectioned view in perspective of yet another embodiment of the merchandiser of the present invention.

Shown in FIG. 10 is yet another embodiment of a merchandiser 120 in accordance with the present invention. Merchandiser 120 does not include a refrigeration mechanism and, therefore, may be more compact than the refrigerated merchandisers 10, 70, 92 of FIGS. 1, 3, and 7, respectively. Non-refrigerated merchandiser 120 is especially useful for dispensing products 124 which do not require refrigeration such as, for example, cigarette packs.

Figure 11:
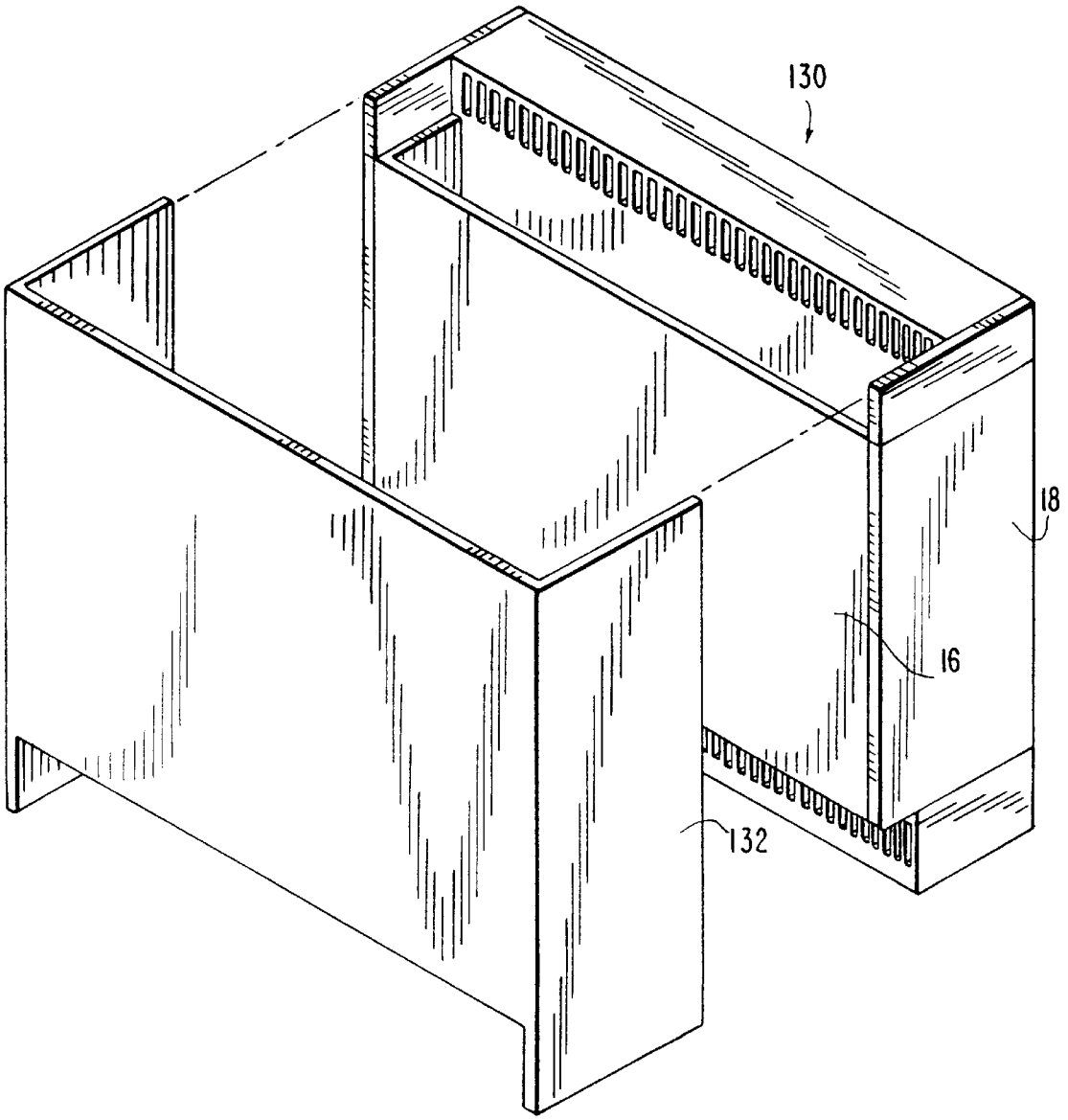
FIG. 11 is a perspective view of still yet another embodiment of the merchandiser of the present invention having a detachable facing.

FIG. 11 depicts a merchandiser 130 with an interchangeable or removable facing 132 which may be selectively and detachably coupled to at least one of the front wall 16 and side walls 18 using any of a variety of well known mechanisms such as, for example, a friction fit, snap sit, etc. The interchangeable facing 132 provides a customized display surface particularly suited for advertising the product within the merchandiser 130. For example, the facing 132 may be used to present any appropriate texture, graphics, text, etc. on the front and side surfaces of the merchandiser 130. Assuming a suitable power source is provided, facing 132 may also include electrical components, such as lighting. The interchangeable facing 132 may be constructed as an integral U-shaped piece or as individual panels.

In operation, the merchandiser 10 is preferably positioned in abutting relation to the cashier counter 36. So disposed, the recessed front surface 30 of the base 24 accommodates a shopper's feet thereby minimizing nuisance to the shopper while he/she transacts with a cashier across the counter 36. A shopper can retrieve with ease products displayed in the merchandiser by, for example, sliding the desired product outwardly from the product dispensing rack 42 in a manner explained hereinabove. The biasing members 54 ensure that a product is always disposed at the top of each column of stacked products and that the space vacated by a retrieved product is automatically filled with the product therebeneath.

While there have been shown and described and pointed out novel features of the invention as applied to preferred embodiments thereof, it will be understood that various omissions and substitutions and changes in the form and details of the devices illustrated, and in their operation, may be made by those of ordinary skill in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A point-of-sale merchandiser for merchandising a plurality of products, comprising:

a housing having a first end and a second end, said housing defining an interior chamber and having an opening in said second end thereof for communication with said chamber;

a dispensing rack disposed in said chamber and having a first end adjacent said first end of said housing and a second end adjacent said second end of said housing, said dispensing rack including:

at least one base plate dimensioned to support a plurality of products stacked thereon;

biasing means for urging said base plate from a first position near said first end of said dispensing rack to a second position near said second end of said dispensing rack; and guide means for guiding said plurality of products stacked on said base plate for movement relative to said housing along a substantially linear path as said base plate moves from its first position to its second position such that said products are sequentially accessible through said opening in said second end of said housing;

a partition disposed in said interior chamber and spaced from a rear wall of said housing, said partition extending across said housing between side walls thereof for defining an air plenum between said rear wall and said partition; and means for cooling said interior chamber, wherein said cooling means comprises an evaporator disposed in said plenum.

2. The merchandiser of claim 1, wherein said guide means includes a plurality of linear rails configured for slidable engagement with said products.

3. The merchandiser of claim 1, wherein said guide means further includes retaining means disposed at an end thereof for defining a limit of linear movement of the product nearest said second end of said dispensing rack.

4. The merchandiser of claim 1, wherein said biasing means includes a spring.

5. The merchandiser of claim 1, wherein said cooling means further comprises a condenser, a compressor and a blower.

6. The merchandiser of claim 5, further comprising a mat projecting from an upper portion of said housing for disposition on a horizontal surface adjacent to said merchandiser.

7. The merchandiser of claim 5, further comprising a removable facing securable to at least one of a front wall and a side wall of said housing.

8. The merchandiser of claim 1, wherein said base plate has an aperture therein for facilitating movement of air therethrough.

9. The merchandiser of claim 1, wherein said dispensing rack further comprising another base plate dimensioned to support a plurality of products stacked thereon, biasing means for urging said another base plate from a first position of said another base plate near said first end of said dispensing rack to a second position near said second end of said dispensing rack, and guide means for guiding said plurality of products stacked on said another base plate for movement relative to said housing along a substantially linear path as said another base plate moves from said first position to said second position such that said products are sequentially accessible through said opening in said second end of said housing.

10. The merchandiser of claim 1, wherein said first and second ends of said housing are a bottom and a top of said housing, respectively, and said first and second ends of said dispensing rack are a bottom and a top of said dispensing rack, respectively.

11. The merchandiser of claim 10, wherein said dispensing rack further comprising another base plate dimensioned to support a plurality of products stacked thereon, biasing means for urging said another base plate from a first position of said another base plate near said bottom of said dispensing rack to a second position near said top of said dispensing rack, and guide means for guiding said plurality of products stacked on said another base plate for movement relative to said housing along a substantially linear path as said another base plate moves from said first position to said second position such that said products are sequentially accessible through said opening in said second end of said housing.

12. The merchandiser of claim 11, wherein said guide means further includes retaining means disposed at a top end thereof for defining a limit of linear movement of the product nearest said top of said dispensing rack.

13. The merchandiser of claim 12, wherein said guide means includes a plurality of linear rails configured for slidable engagement with said products.

14. The merchandiser of claim 11, wherein said biasing means includes a spring.

15. A point-of sale merchandiser for merchandising a plurality of products, comprising:

a housing having a first end and a second end, said housing defining an interior chamber and having an opening in said second end thereof for communication with said chamber;

a partition disposed in said interior chamber for defining an air plenum on one side of said partition and a rack-receiving chamber on the opposing side of said partition, said air plenum and said rack-receiving chamber being in fluid communication with each other such that cooled air can be channeled through said air plenum and into said rack-receiving chamber; and a dispensing rack disposed in said rack-receiving chamber and having a first end adjacent said first end of said housing and a second end adjacent said second end of said housing, said dispensing rack including:

at least one base plate dimensioned to support a plurality of products stacked thereon;

a biasing member, operatively connected to said at least one base plate, for urging said at least one base plate from a first position near said first end of said dispensing rack to a second position near said second end of said dispensing rack; and a guide for guiding said plurality of products stacked on said base plate moves from its first position to its second position such that said products are sequentially accessible through said opening in said second end of said housing.

16. The merchandiser of claim 15, further comprising a cold wall disposed proximate said dispensing rack, said cold wall including means for channeling a cooling fluid therethrough for chilling said dispensing rack.

17. The point-of-sale merchandiser of claim 15, further comprising a cooling device operatively connected to said air plenum for generating said cooled air.

18. The point-of-sale merchandiser of claim 15, wherein said cooling device is disposed in said interior chamber.

19. The point-of-sale merchandiser of claim 15, wherein said cooling device includes an evaporator disposed in said air plenum.

20. The point-of-sale merchandiser of claim 15, wherein said cooling device includes a blower disposed in said air plenum.

* * * * *